United States Patent [19]

Seifert et al.

[11] 4,274,447

[45] Jun. 23, 1981

[54] BEARING MOUNT FOR A WARP BEAM

[75] Inventors: Eberhard Seifert, Rickenbach-Sulz; Philippe John, Winterthur, both of Switzerland

[73] Assignee: Sulzer Brothers Limited, Winterthur, Switzerland

[21] Appl. No.: 116,614

[22] Filed: Jan. 29, 1980

[30] Foreign Application Priority Data

Feb. 19, 1979 [CH] Switzerland ..... 1615/79

[51] Int. Cl.[3] ..... D03D 49/02

[52] U.S. Cl. ..... 139/97

[58] Field of Search ..... 139/1 R, 97, 100, 104, 139/109, 110; 28/172; 66/203; 242/58

[56] References Cited

U.S. PATENT DOCUMENTS 1,588,828 6/1926 Wattie ..... 139/79

2,424,400 7/1947 Kronoff ..... 139/97

2,447,227 8/1948 Bergstrom ..... 139/97

FOREIGN PATENT DOCUMENTS 306342 4/1955 Switzerland ..... 139/97

*Primary Examiner*—Henry Jaudon

*Attorney, Agent, or Firm*—Kenyon & Kenyon

[57] ABSTRACT

The support arm of the bearing mounting is freely supported from the holder so as to move vertically up and down so that vibrations of the warp beam which occur during operation cannot be transmitted to the floor of the weaving room or building. The support arm is adjustable rotatably about the holder as well as axially along the holder. In addition, a web connection can be used to fix an intermediate part of the support arm to another beam within the machine frame on the warp side of the main beam.

7 Claims, 1 Drawing Figure

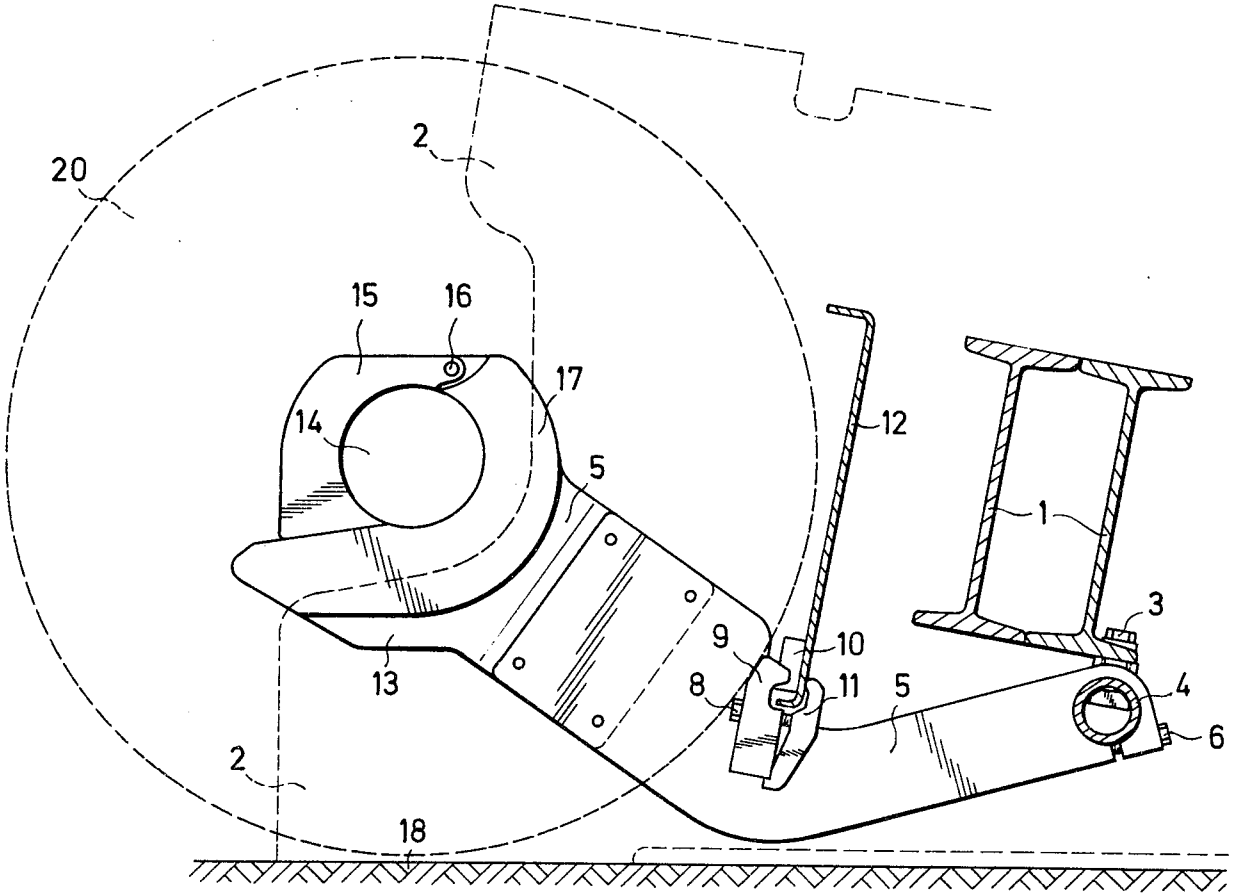
1
2
3
4
5
6
8
9
10
11
12
13
14
15
16
17
18
20

BEARING MOUNT FOR A WARP BEAM

This invention relates to a bearing mount for a warp beam.

As is known, warp beams have frequently been mounted on the frame of a weaving machine via a support arm which is fixed to the machine frame. Such support arms are frequently used for the intermediate bearing of the warp beam. As described in Swiss Patent 306,342, the support arm is usually rigidly fixed on a main beam of the machine frame with the end of the arm on the warp side supported on the floor of the weaving room by means of a foot. In addition, the support arm is fixed to a second beam of the machine frame located between the main beam and the rear foot.

Because the support arm for the warp beam is fixed at different points, it is possible that the arm will experience some flexural stress when installed. Further, this stress may increase during operation due to the usual vibrations of the machine. It is also quite possible that the vibrations of the warp beam, particularly when the beam is of very large diameter and when the beam exerts considerable force on the foot, will cause the varying supporting force originating from the vibration to be transmitted to the floors of the building in which the weaving machine is located. This force may, in some cases, assume relatively high values so that the building may become damaged. Further, the warp beam may, on occasion, be lifted from the floor together with the foot because of a high warp yarn tension and the decreasing diameter of the warp beam during operation. Given an unskilled adjustment, the rear end of the weaving machine may also be undesirably lifted by the foot.

Accordingly, it is an object of this invention to provide a bearing mount for a warp beam which will not transmit vibrations directly to the floor of a building.

It is another object of the invention to avoid lifting of the rear end of a weaving machine during operation via an intermediate bearing mount of a warp beam.

It is another object of the invention to provide an intermediate bearing mounting for a warp beam which is free of stresses when set in place.

Briefly, the invention is directed to the use of a bearing mounting for a warp beam in a weaving machine having a frame and a main beam extending transversely of the frame. In accordance with the invention, the bearing mounting includes a holder which is secured to the main beam, a support arm which is adjustably mounted on the holder for movement in a vertical plane while extending from the holder transversely of the main beam and a bearing at the free end of the support arm for journalling a warp beam therein.

The holder for the support arm is of tubular cross-sectional shape or other similar rod shape so as to permit rotation of the support arm thereon. In addition, the support arm includes a clamping screw for fixing the arm to the holder in a stepless manner relative to the rotational position of the arm on the holder. Further, the support arm is displaceable along the holder. Thus, the support arm can be very easily axially displaced and fitted on the machine frame so as to be free from stress in any rotational position.

The end of the arm on the warp side which receives the warp beam bearing can be constructed to project out freely. Thus, certain vibrations of the kind that may occur with very heavy warp beams are possible without being transmitted harmfully to the building by any supporting elements.

The weaving machine also has a second beam which extends transversely of the frame between the main beam and the bearing. In this case, the bearing mounting includes a means for adjustably clamping the support arm to this second beam.

These and other objects and advantages of the invention will become more apparent from the following detailed description and appended claims taken in conjunction with the accompanying drawings in which:

The drawing illustrates a cross-sectional view of a part of a weaving machine frame employing a bearing mounting in accordance with the invention.

Referring to the drawing, the weaving machine includes a frame and a main beam 1 which extends transversely of the frame between two side plates 2 (of which only one is shown) which rest on a floor 18. The weaving machine is otherwise of conventional structure such that the frame includes a warp beam end for receiving a warp beam 20 thereat on a horizontal axis.

A bearing mounting for the warp beam 20 includes a holder 4 which is secured to the main beam 1 via a screw connection 3. As indicated, the holder 4 is of tubular cross-sectional shape but may be of any other suitable rod-shape.

The beam 1 and holder 4 extend in parallel relationship to each other as well as to the weft processed in the weaving machine and the warp beam 20, i.e. at right angles to the drawing plane. In addition, the bearing mounting includes a support arm 5 which is adjustably mounted on the holder 4 for movement in a vertical plane. This support arm 5 extends from the holder 4 transversely of the main beam 1 towards the warp beam end and transversely of the axis of the warp beam 20. As shown, the support arm 5 includes a clamping screw 6 for fixing the arm 5 to the holder 4 steplessly relative to the rotational position of the arm 5 on the holder 4.

The support arm 5 is rotatably adjustable about the holder 4 while also being displaceable along the holder 4. In this regard, the clamping screw 6 serves to fix the axial position as well as the rotational position of the arm 5 with respect to the holder 4.

The bearing mounting also includes a bearing 14 at the free end 13 of the support arm 5 for journalling the warp beam 20 therein. As shown, the bearing 14 has a main part 17 and a top part 15 which is pivotally mounted via a pin 16 to the main part 17. The top part 15 can be pivoted about the pin 16 so as to be opened a sufficient amount to permit the warp beam 20 to be fitted into the bearing 14. The free end 13 of the arm 5 is disposed above a weaving room floor 18 in cantilevered fashion without being supported on the floor 18. Thus, the free end 13 can move up and down to varying degrees as the end 13 vibrates during operation to the extent that the elasticity of the arm 5 permits this movement.

As shown, the weaving machine also has a second beam 12 extending transversely of the machine frame between the main beam 1 and the bearing 14. In this case, the bearing mounting also includes a means for adjustably clamping the support arm 5 to the beam 12 at various heights. As shown, this clamping means is located substantially at the middle of the arm 5 and is in the form of a wedge connection which includes a screw 8 and various wedge parts 9, 10, 11. As indicated, part 10 is in the form of an adjustable block which is fitted into the contour of the beam 12 while the parts 9, 11 form wedge-like blocks for clamping about the beam 12 and block 10 upon threading of the screw 8 through one block 9 into the other block 11.

When affixing the bearing mounting to the machine frame, the holder 4 is first secured in place via the screw connection 3 to the main beam 1. Thereafter, the arm 5 is fitted onto the holder 4 with the screw 6 released. The arm 5 is then advanced axially along the holder 4 to the required position on the holder 4. The screw 6 is then tightened just slightly initially. The wedge connection 8–11 is then fitted to the beam 12 and completely tightened. Thereafter, the screw 6 is tightened in the selected rotational position as defined by the beam 12 and wedge connection 8–11.

It is to be noted that a weaving machine may contain a number of support arms 5. In particular, the arm can be used for the middle bearing of a warp beam 20 which is disposed between two outer bearings. This latter arrangement is frequently required in the case of multi-part warp beams.

What is claimed is:

1. In a weaving machine having a frame and a main beam extending transversely of said frame;

a bearing mounting for a warp beam, said bearing mounting including a holder secured to and extending along said main beam;

a support arm adjustably mounted on said holder for movement in a vertical plane and along said main beam, said support arm extending from said holder transversely of said main beam;

a bearing at a free end of said support arm for journalling a warp beam therein;

a second beam extending transversely of said frame between said main beam and said bearing; and means for adjustably clamping said support arm to said second beam.

2. In a weaving machine as set forth in claim 1, said holder being of tubular cross-sectional shape for rotation of said support arm thereon.

3. In a weaving machine as set forth in claim 2, wherein said support arm includes a clamping screw for fixing said arm to said holder steplessly relative to the rotational position of said arm on said holder.

4. In a weaving machine as set forth in claim 1 wherein said support arm is displaceable along said holder.

5. In a weaving machine, the combination comprising a frame including a warp beam end for receiving a warp beam thereat on a horizontal axis;

a main beam extending transversely of said frame;

a second beam extending transversely of said frame;

a holder secured to said main beam;

a support arm adjustably mounted on said holder for movement in a vertical plane, said support arm extending from said holder towards said warp beam end and transversely of said axis;

a bearing at a free end of said support arm for journalling a warp beam therein on said axis; and means for adjustably clamping said support arm to said second beam.

6. The combination as set forth in claim 5 wherein said support arm is rotatable about and displaceable along said holder and which further includes a clamping screw for fixing said arm to said holder in a predetermined position.

7. The combination as set forth in claim 6 wherein said holder is removably secured to said main beam.

* * * * *